US007603966B1

(12) United States Patent
Beebe

(10) Patent No.: US 7,603,966 B1
(45) Date of Patent: Oct. 20, 2009

(54) SYSTEM FOR RAPIDLY POSITIONING A SMALL ANIMAL ON A VETERINARY TABLE

(76) Inventor: Keith F. Beebe, 249 Maple St., Hinsdale, MA (US) 01235

( * ) Notice: Subject to any disclaimer, the term of this patent is extended or adjusted under 35 U.S.C. 154(b) by 176 days.

(21) Appl. No.: 11/711,978

(22) Filed: Feb. 28, 2007

Related U.S. Application Data

(60) Provisional application No. 60/778,051, filed on Mar. 1, 2006.

(51) Int. Cl.
*A61D 3/00* (2006.01)

(52) U.S. Cl. ..... 119/755; 119/756

(58) Field of Classification Search ..... 119/755, 119/417, 421, 756, 752, 753, 724; 600/217; 5/621, 622, 623, 624
See application file for complete search history.

(56) References Cited

U.S. PATENT DOCUMENTS

| | | | | | |
|---|---|---|---|---|---|
| 2,708,422 | A | | 5/1955 | Morrison | |
| 2,845,925 | A | * | 8/1958 | Jayle | 600/233 |
| 3,215,834 | A | | 11/1965 | Tayman | |
| 3,286,694 | A | | 11/1966 | Landy | |
| 3,542,015 | A | * | 11/1970 | Steinman | 600/217 |
| 3,762,401 | A | * | 10/1973 | Tupper | 600/217 |
| 4,030,719 | A | | 6/1977 | Gabriele et al. | |
| 4,184,451 | A | | 1/1980 | Carlin | |
| 4,185,636 | A | * | 1/1980 | Gabbay et al. | 606/148 |
| 4,321,890 | A | | 3/1982 | Lange et al. | |
| D268,958 | S | | 5/1983 | Lange et al. | |
| RE32,021 | E | * | 11/1985 | Scott, Jr. | 600/217 |
| 4,581,754 | A | | 4/1986 | Donovan | |
| 4,693,212 | A | | 9/1987 | Black | |
| D297,473 | S | | 8/1988 | Carlin | |
| 4,779,858 | A | | 10/1988 | Saussereau | |
| 4,911,106 | A | | 3/1990 | Goodwin | |
| 4,934,320 | A | | 6/1990 | Cresap, III | |
| 5,207,703 | A | * | 5/1993 | Jain | 606/232 |
| 5,329,934 | A | | 7/1994 | Bowman | |
| 5,383,425 | A | | 1/1995 | Bleacher | |
| 5,385,119 | A | | 1/1995 | Tarulli | |
| 5,785,649 | A | * | 7/1998 | Fowler, Jr. | 600/233 |
| 5,823,146 | A | | 10/1998 | Alaniz et al. | |
| 6,077,221 | A | * | 6/2000 | Fowler, Jr. | 600/233 |
| 6,190,312 | B1 | * | 2/2001 | Fowler, Jr. | 600/231 |
| 6,318,372 | B1 | | 11/2001 | Hiebert | |
| 6,675,741 | B2 | | 1/2004 | Remmler | |
| 7,055,194 | B2 | * | 6/2006 | Arthur | 5/428 |
| 7,303,568 | B2 | * | 12/2007 | Jannot | 606/148 |
| 2004/0186356 | A1 | * | 9/2004 | O'Malley et al. | 600/231 |

* cited by examiner

*Primary Examiner*—Yvonne R. Abbott
(74) *Attorney, Agent, or Firm*—Malcolm J. Chishom, Jr.

(57) ABSTRACT

The system (10) includes a guide plate (32) covering at least about fifty percent of a distance along a first or a second end edge (28, 30) between first and second side edges (24, 26) of a veterinary table (12). The plate (32) defines five or more cord positioning guides (36) per foot of extension of the guide plate (32) between the first and second table side edges (24, 26). The cord positioning guides (36) secure an animal restraint cord (38) against movement toward the first or second table side edges (24, 26). The cord (38) is secured at one end to a limb (48) of a small animal (22) such as a dog, extends through one of a variety of cord positioning guides (36), and is secured against movement toward the animal (22) by a cord securing apparatus (52).

11 Claims, 3 Drawing Sheets

SYSTEM FOR RAPIDLY POSITIONING A SMALL ANIMAL ON A VETERINARY TABLE

CROSS REFERENCE TO RELATED APPLICATION

This Application claims the benefit of U.S. Provisional Patent Application Ser. No. 60/778,051 that was filed on Mar. 1, 2006, entitled "Rapid System of Positioning Small Animals for Veterinary Radiology" which is incorporated herein by reference.

TECHNICAL FIELD

The present invention relates to positioning devices and systems for securing small animals such as dogs or cats to veterinary tables for radiological and similar purposes.

BACKGROUND ART

In veterinarian arts, it is well known that small animals such as dogs and cats are frequently injured and must be carefully examined, such as by x-rays or other imaging technologies, and may also have to have limbs set into casts or braces, and often may also have to undergo surgical procedures. In such circumstances, the small animal is typically anesthetized to become immobile and then the animal is secured to a veterinary table for examination and/or treatment by a veterinarian.

A common example of such treatment commences with an imaging examination such as an x-ray of an injured limb. For such purposes, the most common method of securing the small animal for an effective x-ray is to first immobilize the animal with anesthesia, and then to secure the animal on a veterinary table through use of deformable sand bags. It is well known that an unconscious animal, such as a dog, may have both fore legs wrapped together with a sand bag that is about eighteen inches long, and about six inches wide, wherein the bag is folded over both paws of the dog's fore legs to keep them from moving. (Such sand bags come in a variety of sizes.) A similar arrangement may be utilized for the dog's rear legs prior to an x-ray of, for example, a hip or shoulder of the dog.

While such sand bag systems have modest effectiveness, they are very time consuming to use, and do not provide for much flexibility in positioning a small animal in various positions other than the dog having a side positioned adjacent a support surface of the veterinary table. Moreover, the sand bags typically require a lot of re-positioning and/or temporary holding of the animal's limbs during use of the x-ray machine. for effective imaging. Such re-positioning and/or temporary holding of the animal's limbs raises a danger of an imaging technician or veterinarian receiving unhealthy exposure to x-ray beams and scatter radiation. It is also known to use sand bags attached to a cord having a fastening noose secured to a limb of the animal. The sand bag may then be positioned over an edge of the veterinary table to variably position the limb of the animal. Such use of a sand bag provides slightly enhanced positioning but raises a grave risk of pulling the unconscious animal off of the table which could injure or worse, could exacerbate and already injured small animal.

Many more complicated efforts have been made to provide for secure fastening of small animals on veterinary tables. For example, U.S. Pat. No. 4,934,320 to Cresap, III that issued on Jun. 19, 1990 shows a complicated "animal restraining device" that uses a hinged tubular frame having an impermeable, pliant sheet that pivots down to cover a small animal on a veterinary table to immobilize the animal for an x-ray. Another "x-ray positioner and restraining device" for small animals is disclosed in U.S. Pat. No. 5,385,119 that issued on Jan. 31, 1995 to Tarulli. It shows an adjustable frame dimensioned to be secured to a support surface of a veterinary table. Clamps are adjustably secured to frame members, and tie-down straps are secured between the clamps and a limb or limbs of the animal to secure the animal against movement. U.S. Pat. No. 4,911,106 to Goodwin also shows a "pet restraining table apparatus" for immobilizing a small animal. The Goodwin apparatus includes a very complicated table with a base with separable upper and lower portions including an elevated outer frame that permits a one-hundred and eighty degree pivotal motion to vary a position of a pet secured within the frame. Goodwin shows cords secured to four limbs of the animal and extending to the surrounding frame to immobilize the four limbs of the animal, primarily for grooming purposes.

More recently, U.S. Pat. No. 6,675,741 that issued on Jan. 13, 2004 to Remmler shows an animal restraint apparatus that includes a contoured shell made of radiolucent material, wherein the shell is dimensioned to receive and secure with a plurality of fastening straps a small animal such as an injured dog, for purposes such as x-ray imaging. The shell is configured so that torso and limb straps secure the animal so firmly that the shell may be placed in several positions to facilitate x-rays of the animal in the shell from several perspectives.

While such known apparatus and/or systems for securing small animals for veterinary purposes solve some inherent problems related to securing small animals, none of these apparatus and/or systems have gained wide spread acceptance in the veterinary field. It is suspected that the known apparatus and systems simply involve too many complicated components to achieve efficient manufacture and utilization. Moreover, most veterinarians already have very expensive veterinary tables associated with imaging technologies, such as very expensive small animal veterinary x-ray machines. Known small animal restraint systems are not readily adaptable to, or a prudent replacement for such veterinary tables. Consequently, most veterinarians simply utilize the above described time-consuming and dangerous sand bag restraint system on their existing veterinary tables.

Accordingly, there is a need for a system for efficiently and rapidly positioning a small animal on a veterinary table that is inexpensive to manufacture, that is easy to use, that may be applied rapidly to an anesthetized small animal, and that may be easily applied as a retrofitted system to existing veterinary tables.

SUMMARY OF THE INVENTION

The invention is a system for rapidly positioning a small animal on a veterinary table. The veterinary table includes a support surface that extends between a first side edge and an opposed second side edge and that also extends between a first end edge and an opposed second end edge of the table. The system includes at least the first end edge or the second end edge of the table having a guide plate covering at least about fifty percent of a distance along the first or second end edge between the first and second side edges. The guide plate defines five or more cord positioning guides per foot of extension of the guide plate between the first and second side edges, and the guide plate defines preferably between about six and about sixteen cord positioning guides per foot of extension of the guide plate between the first and second side edges. The cord positioning guides are for securing an animal restraint cord against movement toward the first side edge or the second side edge of the table. An exemplary cord positioning guide is simply a slot in the guide plate. The animal restraint cord includes an animal limb fastener at a first end of the cord for fastening the cord to a limb of a small animal adjacent the support surface of the table. The cord also includes an elongate section configured to extend from the small animal limb and through a cord positioning guide. The system also includes cord securing apparatus adjacent the guide plate for selectively securing the cord within a cord positioning guide against movement toward the small animal limb.

In a preferred embodiment, the guide plate is a separate component that may be secured to an existing veterinary table and the cord positioning guides are slots that are configured to prohibit lateral movement of the cords out of the slots toward the side edges of the table. The cord securing apparatus may be a first cam-cleat secured to the guide plate below the cord positioning guides ("below" meaning with respect to the direction of gravity). The preferred embodiment would provide for first and second animal restraint cords for securing for example both fore legs of a dog, and in this embodiment a second cam-cleat would also be secured to the guide plate below the cord positioning guides for securing the second animal restraint cord. The preferred embodiment would also include a second guide plate similar to the above-described guide plate, secured to the other of the first or second end edges of the table having third and fourth animal restraint cords and a corresponding cord securing apparatus, such as third and fourth cam-cleats adjacent the second guide plate.

Such a preferred system can simply have both guide plates retro-fitted to the opposed first and second end edges of the veterinary table, such as by metal bolts or other known fastening devices. With use of the four animal restraint cords, four limbs of an anesthetized small animal may be rapidly and efficiently secured to fastener ends of the cords such as simple slip nooses over each animal paw. The elongate sections of each cord may then be placed in one of the many cord positioning guide slots to best position the animal in one of a virtually unlimited number of positions to facilitate the best possible x-ray or other treatment. The cords would then be inserted into the cam-cleats, and then drawn in a direction away from the animal to achieve a desired limb extension and optimal tension to best position the animal without any risk of harm to the animal. The cam-cleats prohibit movement of the cords in a direction toward the animal. After an imaging procedure or other treatment of the animal, the cords may simply be pulled away from the table out of the cam-cleats and then the slip nooses may be removed from the animal's limbs to release the animal.

As is apparent, the preferred embodiment provides for an extraordinarily wide array of positioning options that may be achieved quite rapidly with an extremely modest amount of materials and apparatus. For example, positioning of the restraint cords in the varying cord positioning guides enables easy placement of the animal in a dorsal recumbency or opposed position by spreading the animal's limbs apart from each other as shown in FIG. 1. In contrast, the animal may be placed on its side with fore legs on top of each other and with the cords from both fore legs going into adjacent positioning guides. The cords would then be inserted into the securing apparatus. This embodiment may also be easily retro-fitted onto existing veterinary tables with a very limited cost in materials to manufacture and time to install.

In alternative embodiments, the cord positioning guides may simply define narrow or "V"-shaped slots that are configured to secure an animal restraint cord against any movement, wherein the cord has a plurality of spaced knots, bumps or beads, so that upon insertion of the cord into the slot between the spaced knots, bumps or beads, the cord is secured against any movement. Alternatively, the cord positioning guides may include the cord securing apparatus within or adjacent the slots or positioning guides, by way of a tensioned clip that secures the cord against movement upon compression of the clip within or adjacent the guide. In addition, the cord positioning guides may consist of pins or holes configured to prohibit lateral movement of the cord toward the side edges. Additionally, the cord securing apparatus may include any simple apparatus to which the cord may be secured to secure it against movement, such as a standard cleat, a post to which the cord may be tied or securely wrapped, etc. Also, the cord may be in the form of a strap configured to be secured by the cord positioning guide at variable positions, such as by holes in the strap secured to pins forming the cord positioning guides, or other strap fastening apparatus known in the art, such as tensioned compression clip fasteners affixed to one-way strap tighteners (such as shown in the above referenced U.S. Pat. No. 6,675,741 to Remmler at FIG. 7, reference numerals 15, 16). An additional alternative embodiment includes the system for rapidly positioning a small animal having one or more guide plates integral with the veterinary table, as opposed to a retro-fitted embodiment.

Accordingly, it is a general purpose of the present invention to provide a system for rapid positioning of a small animal on a veterinary table that overcomes deficiencies of the prior art.

It is a more specific purpose to provide a system for rapid positioning of a small animal on a veterinary table that may be efficiently manufactured, easily retro-fitted to a veterinary table at modest cost, and rapidly utilized while minimizing any risk of harm to the animal and user of the system.

These and other purposes and advantages of the present system for rapid positioning of a small animal on a veterinary table will become more readily apparent when the following description is read in conjunction with the accompanying drawings.

DESCRIPTION OF THE PREFERRED EMBODIMENTS

Figure 1:
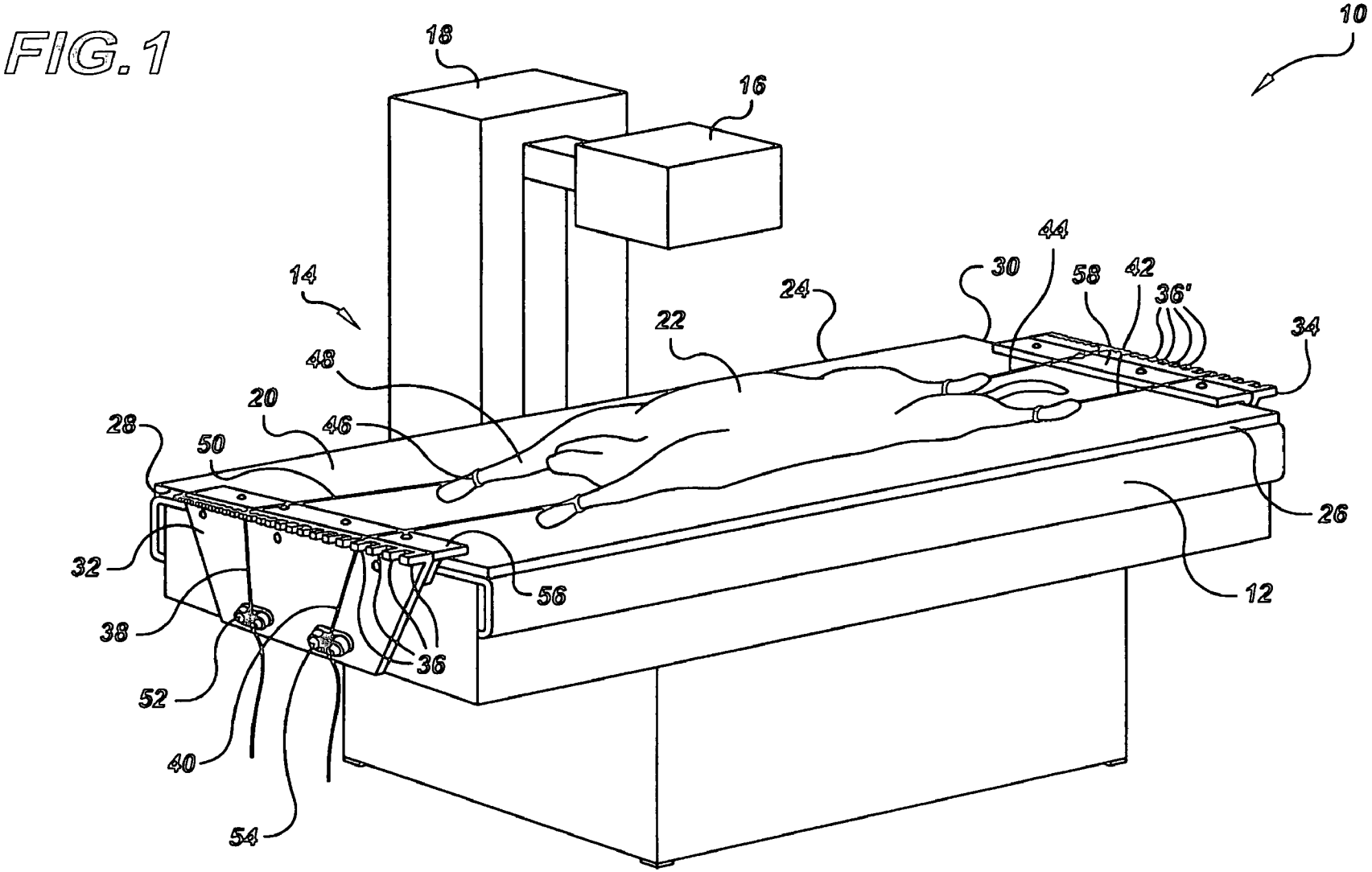
FIG. 1 is a perspective view of a preferred embodiment of a system for rapid positioning of a small animal on a veterinary table constructed in accordance with the present invention, showing the system secured to opposed end edges of a veterinary table and securing a dog adjacent a support surface of the table.

Referring to the drawings in detail, a preferred embodiment of a system for rapid positioning of a small animal on a veterinary table is shown in FIG. 1, and is generally designated by the reference numeral 10. The veterinary table 12 may be part of a veterinary x-ray machine 14 having an adjustable x-ray emitter 16 secured to a variable-position x-ray tower 18, or a fixed-position x-ray tower 18 secured to a variable position table 12, as is well known in the art. The veterinary table 12 includes a support surface 20 for supporting a small animal 22, such as a dog. The support surface extends between a first side edge 24 and an opposed second side edge 26, and extends between a first end edge 28 and an opposed second end edge 30.

The preferred embodiment of the system 10 shown in FIG. 1 includes the first end edge 28 having a first guide plate 32, and the second end edge 30 having a virtually identical second guide plate 34, wherein each guide plate 32, 34 covers at least about fifty percent of a distance along the first and second end edges 28, 30 between the first and second side edges 24, 26. (For purposes herein the word "about" is to mean plus or minus fifteen percent.) Each guide plate 32, 34 also defines five or more cord positioning guide means 36, 36' per foot of extension of the guide plate 32, 34 between the first and second side edges 24, 26. In a preferred embodiment, each guide plate 32, 34 defines between about six and about sixteen cord positioning guide means 36, 36' per foot of extension of the guide plates 32, 34 between the first and second side edges 24, 26. In a further preferred embodiment, each guide plate 32, 34 would define between about 10 and about 14 cord positioning guides means 36 per foot of extension of the guide plates 32, 34 between the first and second side edges 24, 26. The cord positioning guide means are for securing an animal restraint cord 38 against movement toward the first side edge 24 or the second side edge 26 of the table 12. In the preferred embodiment shown in FIGS. 1-3, the cord positioning guides are simply slots 36, 36' defined in the guide plates 32, 34. (The reference numeral 36' is for the cord positioning guide means in the second guide plate 34). In alternative embodiments, the guide positioning means may also include any other structure capable of prohibiting movement of the animal restraint cord 38 contacting the cord positioning guide means 36 toward the first or second side edges 24, 26, such as pins (not shown), rods (not shown), holes (not show), "V"-shaped slots (not shown), etc. defined in, or secured to the guide plate 32.

The animal restraint cord 38 may be a first restraint cord 38, wherein the system 10 also includes a second restraint cord 40, a third restraint cord 42, and a fourth restraint cord 44, as shown in FIG. 1, for securing four limbs of the small animal 22. Each animal restraint cord 38, 40, 42, 44 may be identical to the first restraint cord 38, and include an animal limb fastener means 46 for temporarily and selectively securing the restraint cord 38 to a limb 48 of the animal 22, such a slip-noose 46, or any other know fastener capable of securing the animal limb 48 to the cord 38. The animal restraint cord 38 also includes an elongate section 50 configured to extend from the small animal limb 48 and the animal limb fastener means 46 through one of the cord positioning guides 36.

The system 10 also includes cord securing means 52 adjacent the guide plate 32 for selectively securing the animal restraint cord 38 within a cord positioning guide 36 against movement toward the small animal limb 48. (For purposes herein the word "selectively" is to mean that a user (not shown) of the system 10 may select to perform a particular described function with a described structure; may select to terminate performance of the function with the structure; or, may select to not perform the described function with the described structure.) As shown in the preferred system 10 of FIG. 1, the cord securing means 52 may be a first cam-cleat 52 secured to the guide plate 32 below the cord positioning guide means 36, so that upon insertion of the first animal restraint cord 38 into the cam-cleat 52, the cam-cleat 52 prohibits movement of the cord 38 toward the animal limb 48. In the FIG. 1 preferred embodiment, the cord securing means may also include a second cam-cleat 54 also secured adjacent the guide plate 32 and below the cord positioning guide means 36 for selectively securing the second restraint cord 40. Additionally, the system 10 of FIG. 1 may also include third and fourth cam-cleats (not shown) secured adjacent the second guide plate 34.

Figure 2:
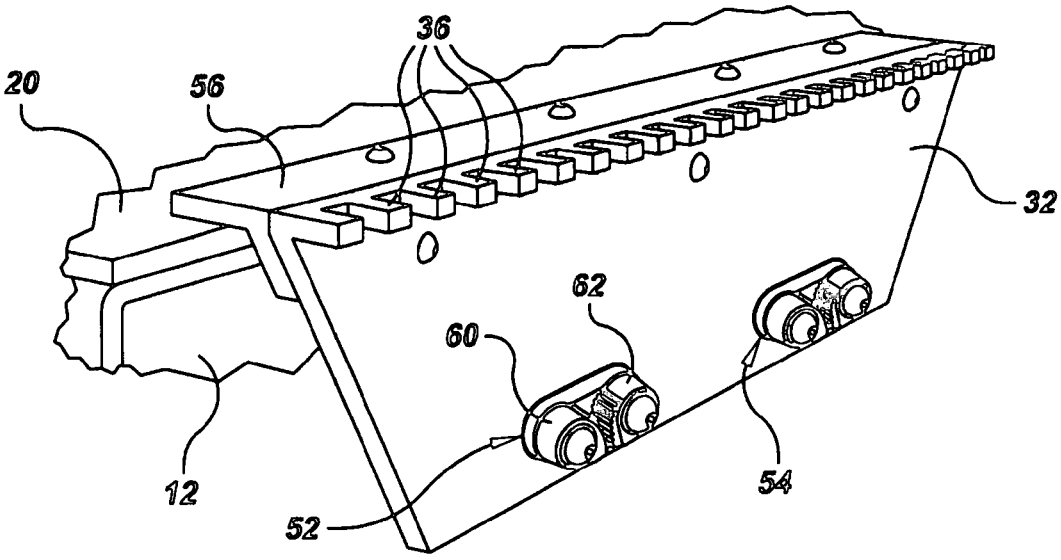
FIG. 2 is a perspective view of a guide plate of the FIG. 1 system, the guide plate defining a plurality of cord positioning guides above a first cam-cleat securing apparatus and above a second cam-cleat securing apparatus.

As shown in FIG. 1, the system having four separate restraint cord securing means 52 provides for efficient securing of all four limbs of the small animal 22 in any of a variety of positions. A desired position of the animal 22 adjacent the support surface 20 of the table is determined by which of the various cord positioning guide means secures the animal restraint cords 38, 40, 42, 44. By simply selecting a desired cord positioning guides 36, 36' for each cord, then inserting the cords 38, 40, 42, 44 into the respective cord securing means 52, 54, and then pulling the cords downward away from the table 12 support surface 20, a user may select a desired animal position and rapidly, conveniently and safely secure the animal 22 in the selected position. As shown in FIGS. 1 and 2, the preferred system may also include a first guide plate adaptor 56 secured between the guide plate 32 and the table 12 and a second guide plate adaptor 58 similarly secured between the second guide plate 34 and the table 12. The adaptors 56, 58 may be necessary for some common tables 12 to provide adequate fastening of the guide plates 32, 34 to various structural features of the table 12 such as a frame (not shown) under the table 12, etc., while other veterinary tables (not shown) may not require the adaptors 56, 58.

Figure 5:
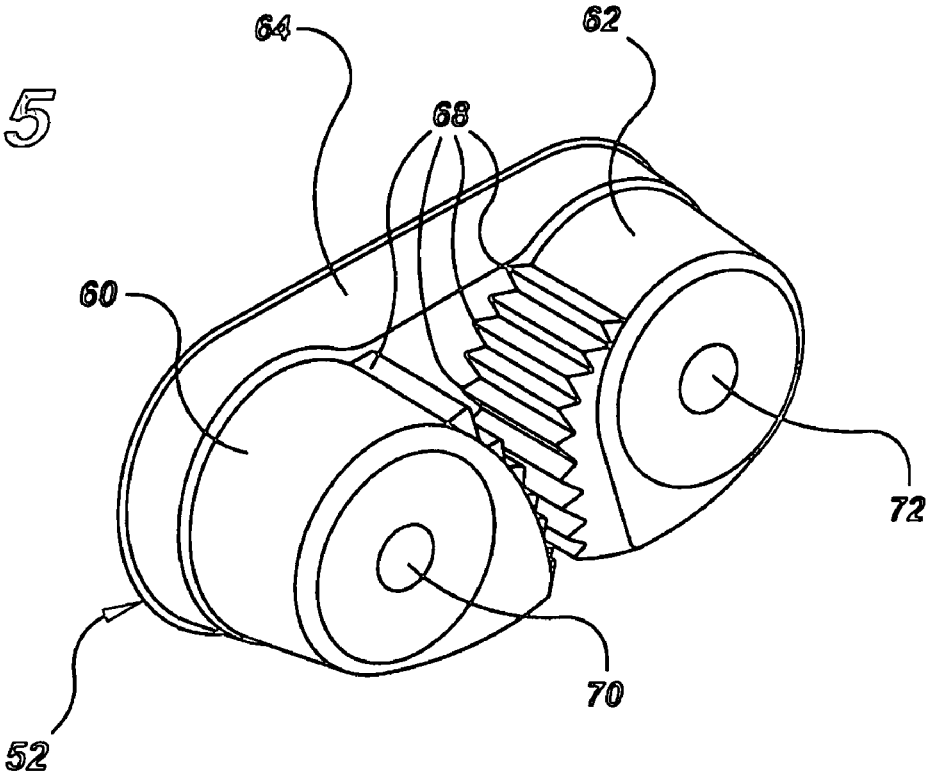
FIG. 5 is an enlarged perspective view of a cam-cleat securing apparatus utilized in the preferred embodiment of the FIG. 1 system for rapid positioning of a small animal on a veterinary table.

FIG. 2 shows an enlarged view or the first guide plate 32 of the FIG. 1 preferred embodiment of the system, wherein the cord positioning guides means 36 in the form of slots 36 may be more easily seen. Additionally, FIG. 2 shows an enlarged view of the first cam-cleat 52 and second cam-cleat 54 that may be identical to the first cam-cleat 52. Such cam-cleats are well known in technology associated with use of ropes ("lines") especially on sailing vessels. An exemplary cam-cleat 52 may be acquired from the "Mauri Pro Sailing LLC" company of Crowley, Tex., U.S.A., under the model name "Harken Micro Carbo-Cam". As seen best in FIGS. 2, 3 and 5, each cam-cleat 52 form of cord securing means has a first cam-half 60 and a second cam-half 62 mounted on a base 64, each cam-half 60, 62 defining a plurality of friction ridges 68. Because of the eccentric alignment of the cam-halves 60, 62 with a first cam-half pivot axle 70 and a second cam-half pivot axle 72, the cam-cleat 52 prohibits movement of a restraint cord 38 in a direction between the cam-halves 60, 62 and perpendicular to axes defined by rotational axes of the pivot axles 70, 72 that would cause the two cam-halves 60, 62 to pivot to contact each other. The cam-cleat 52 permits movement of the restraint cord 38 in an opposite direction, thereby facilitating application of appropriate tension to the restraint cord 38 in a direction away from the limb 48 of the small animal 22.

Figure 3:
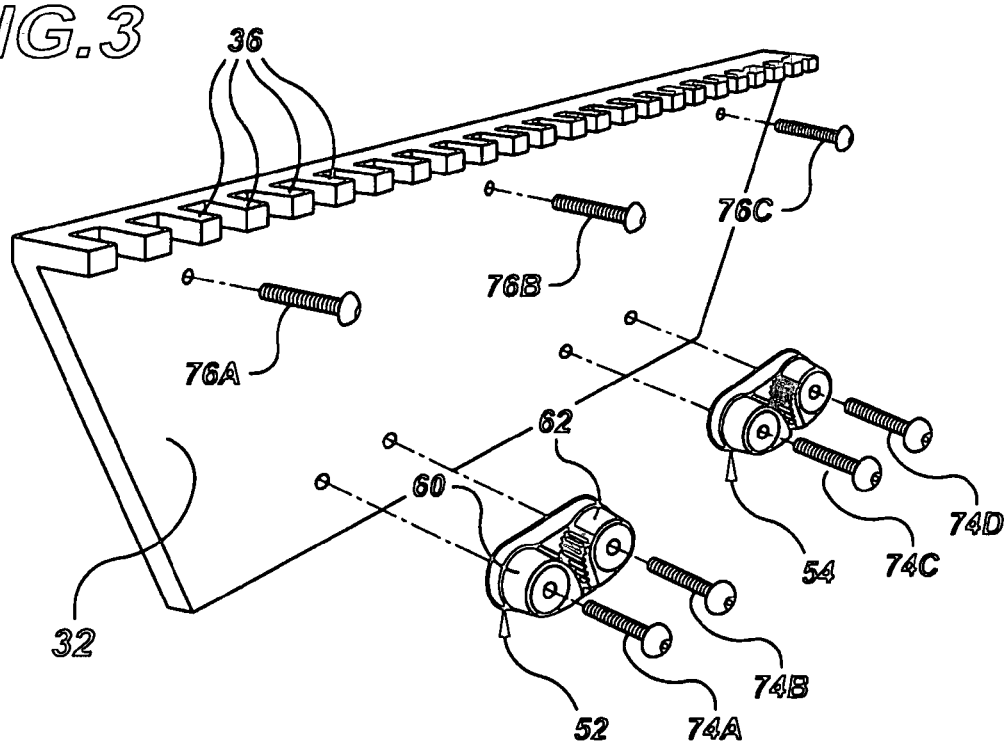
FIG. 3 is a perspective view of the FIG. 2 guide plate showing fastening bolts removed from the guide plate and cam-cleat securing apparatus.

FIG. 3 shows that the pivot axles 70, 72 of the first cam-cleat 52 may simply be fastening bolts 74A, 74B, and that the second cam-cleat 54 may similarly use such fastening bolts 74C, 74D to secure the cam-cleats 52, 54 to the guide plate 32. Also shown in FIG. 3 are guide plate fastening bolts 76A, 76B, 76C that may be utilized to secure the first guide plate 32 to the table 12 directly, or through the first guide plate adaptor 56 as shown in FIG. 2. While FIGS. 1-3 show the guide plate 32 as a separate component that is secured to the table 12, it is stressed that in alternative embodiments of the system 10, the guide plates 32 or both the first and second guide plates 32, 34 may be integral with the opposed first and second end edges 28, 30 of the table 12.

Figure 4:
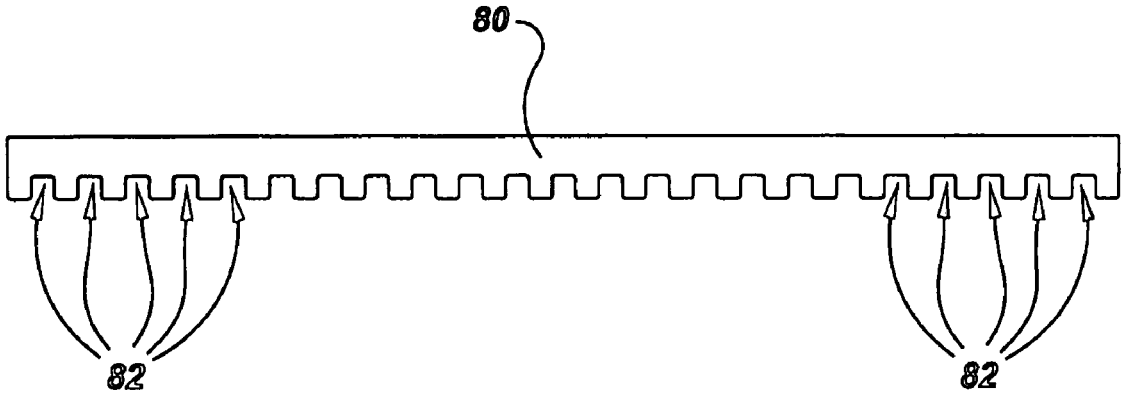
FIG. 4 is a top plan view of an alternative embodiment of a guide plate of the system for rapid positioning of a small animal on a veterinary table, showing a plurality of cord positioning guide slots defined within the guide plate.

FIG. 4 shows a top view of such an alternative end-plate 80 that may be integral with the table 12, having cord positioning guide means 36 in the form of a plurality of slots 82, as described above. While the cord positioning guide means 36 may be slots, the guide means may also be in the form of pins or rods (not shown) extending away from the support surface 20 of the table 22 to engage holes (not shown) in strap-shaped animal restraint cords (not shown) to thereby prohibit movement of the restraint cord 38 from the cord positioning means 36 toward the first or second side edges 24, 26 of the table 12.

In alternative embodiments, the cord securing means 52 may also be in any structural form that will prohibit movement of the animal restraint cord 38 toward the small animal limb 48. For example, the cord securing means 52 may simply take the form of the cord positioning guide means 36 being configured to engage narrow portions (not shown) of the animal restraint cord 38 between expanded portions (not shown) of the animal restraint cord 38, such as if the cord 38 had a plurality of expanded beads, or expanded knots separated by narrow portions of the cord 38. With such an animal restraint cord 38, a user may simply position a narrow section of the cord within the slot 82 of the cord positioning means 52, wherein the slot 82 is configured to be too narrow to permit passage of the expanded portion of the cord through the slot 82. Additionally, the cord securing means 52 may be in the form of any apparatus known in the art to which a cord may be secured to restrict movement of the cord 38 toward the animal limb 48, such as a standard cleat (not shown), a post (not shown) to which the cord may be wrapped, tied or otherwise secured. The cord securing mean may also include a first half of a tensioned compression clip fastener (not shown) secured to the guide plate adjacent the cord positioning guide means to which a second half of the compression clip fastener may be selectively inserted to secure the cord 38 against movement toward the animal limb 48, while the cord 38 or a fixed half of the fastener also includes a one-way strap fastener, such as shown in the above referenced U.S. Pat. No. 6,675,741 to Remmler at FIG. 7, reference numerals 15, 16), which Patent is hereby incorporated herein by reference. In such an embodiment of the cord securing means 52, after selecting which of the cord positioning guide means slots 82 to utilize, a user may simply secure the two halves of the tensioned compression clip fastener together, and then pull on the one-way strap fastener to apply adequate tension to position the limb 48 of the small animal 22 in a desired position.

The present system 10 for rapidly positioning a small animal 22 on a veterinary table 12 may be manufactured so that the guide plates 32, 34 and the adaptor plates 56, 58 may be made of extruded aluminum, plastic, wood, rubberized composites, or any materials known in the art that are capable of performing the functions described above. The animal restraint cords 38, 40, 42, 44 may also be made of any material that has adequate strength for the described functions and may be sanitized between usages if necessary, such as plastic, etc. In a preferred embodiment, the animal restraint cords 38, 40, 42, 44 are made of a non-stretch material to facilitate precise control of positioning of the small animal 22. The described system 10 for rapidly positioning a small animal 22 on a veterinary table 12 may include the two opposed guide plates 32, 34, or in some embodiments may only utilize one guide plate 32 and its associated cord positioning guide means 36, 36' and cord securing means 52, which cord securing means may be the first and second cam-cleats 52, 54 as shown in FIGS. 2 and 3, or may be the alternative cord securing means described above. Alternative embodiments of the system 10 may also include using a plurality of two or more guide plates 32, 34 at varying positions on both the end edges 28, 30 and on the side edges 24, 26 of the table 12, wherein the system 10 provides flexibility of animal positioning as a function of the many cord positioning guide means 36, 36' covering at least fifty percent of an end edge 28, 30 of the table. While the guide plates 32, 34 have been described and illustrated as single piece units, the system 10 includes guide plates in any form (e.g., two or three-piece units) that cover at least fifty percent of the described edge, and that have five or more cord positioning guides per foot of the extension of the guide plates between the opposed side edges 28, 30.

The system 10 for rapidly positioning a small animal 22 on a veterinary table 12 provides elegantly simple structures as described above that facilitate rapid and safe positioning of the small animal 22 in any of a virtually unlimited variety of positions on the table 12. The components of the system 10 may be manufactured at a very modest cost, and perhaps most importantly, the components may be quickly, safely and efficiently retro-fitted to existing veterinary tables. In addition, modern veterinary tables 12 may also be manufactured with the system 10 integrated into the table 12 at manufacture for even greater efficiencies.

In addition, by facilitating such variable, rapid and secure positioning of the small animal 22, the system 10 minimizes any need for a user (not shown) of the system 10 to be in the room while the x-ray machine 14 is operating. As is known in the art, it has been lawful for users of veterinary x-ray machines 14 to remain in the room while the x-ray machine is being operated. However, this practice is increasingly seen as excessively dangerous, and at least two states, California and New York, have already outlawed this practice. The present system 10 for rapidly positioning a small animal 22 on a veterinary table virtually eliminates any need for a user to remain in the room in which the x-ray machine is operating by providing such rapid, variable and secure positioning of the animal 22.

The system 10, therefore also includes the method of using the system 10, including the steps of securing a guide plate 32 to at least one of a first end edge 28 or second end edge 30 of a veterinary table so that the guide plate 32 covers at least fifty percent of a distance along the end edge 28, 30 between the first and second side edges 24, 26 of the table 12, wherein the guide plate 32 defines five or more cord positioning guide means 36 per foot of extension of the guide plate 32 between the opposed side edges 24, 26 of the veterinary table 12; positioning the small animal 22 on the support surface 20 of the veterinary table 12; securing the limb fastening end 46 of an animal restraint cord 38 to a limb 48 of the small animal 22; prohibiting movement of the cord 38 toward the first side edge 24 or the second side edge 26 by securing the elongate section 50 of the cord 38 within a pre-selected cord positioning guide 36; and, then securing the animal restraint cord 38 against movement toward the small animal 22.

While the present invention has been disclosed with respect to the described and illustrated embodiments of the system 10 for rapidly positioning a small animal 22 on a veterinary table 12, it is to be understood that the invention is not to be limited to those embodiments. Accordingly, reference should be made primarily to the following claims rather than the foregoing description to determine the scope of the invention.

What is claimed is:

1. A system (10) for rapidly positioning a small animal (22) on a veterinary table (12), the veterinary table (12) including a support surface (20) extending between a first side edge (24) and an opposed second side edge (26), and also extending between a first end edge (28) and an opposed second end edge (30), the system (10) comprising:

a. at least the first end edge (28) or the second end edge (30) including a separate-component, retro-fitted guide plate (32) covering at least about fifty percent of a distance along the first or second end edge (28, 30) between the first and second side edges (24, 26), the separate-component, retro-fitted guide plate (32) being a separate component from the veterinary table and defining five or more cord positioning guide means (36) per foot of extension of the retro-fitted guide plate (32) between the first and second side edges (24, 26), the cord positioning guide means (36) being for securing an animal restraint cord (38) against movement toward the first side edge (24) or the second side edge (26) of the table;

b. the animal restraint cord (38) defining an animal limb fastener means (46) at a first end of the cord (38) for fastening the cord (38) to a limb (48) of the small animal (22) adjacent the support surface (20) of the table (12), the cord (38) also defining an elongate section (50) configured to extend from the small animal limb (48) through the cord positioning guide means (36); and, c. cord securing means (52) adjacent the separate-component, retro-fitted guide plate (32) for selectively securing the cord (38) within the cord positioning guide means (36) against movement toward the small animal limb (48).

2. The system (10) of claim 1, further comprising the other of the first end edge (28) or the second end edge (30) including a second separate-component, retro-fitted guide plate (34) covering at least about fifty percent of a distance along the first or second end edge (28, 30) between the first and second side edges (24, 26), the second retro-fitted guide plate (34) defining five or more cord positioning guide means (36') per foot of extension of the second retro-fitted guide plate (34) between the first and second side edges (24, 26), and, second, third and fourth animal restraint cords (40, 42, 44) configured to be secured to the small animal (22) and within the cord securing means (52, 54) adjacent the first and second separate-component, retro-fitted guide plates (32, 34).

3. The system (10) of claim 1, wherein the cord securing means (52) comprises a plurality of cam-cleats (52, 54).

4. The system of claim 1, wherein the cord positioning guide means (36) comprises a plurality of slots (36) defined within the separate-component, retro-fitted guide plate (32), the slots being configured to prohibit movement of the animal restraint cord (38) within the slots (36) toward the first side edge (24) or the second side edge (26).

5. The system (10) of claim 1, wherein the separate-component, retro-fitted guide plate (32) defines between about ten and about fourteen cord positioning guide means (36) per foot of extension of the separate-component, retro-fitted guide plate (32) between the first and second side edges (24, 26).

6. The system of claim 1, wherein the cord securing means (52) further comprises the cord positioning guide means (36) being configured to receive and secure against movement toward the small, animal (22) narrow portions of the animal restraint cord (38) defined between expanded portions of cord (38).

7. The system of claim 6, wherein the expanded portions of the animal restraint cord (38) comprise a plurality of beads configured to have diameters greater than a widest distance across slot-shaped cord positioning guides (36) so that the slot-shaped cord positioning guides (36) cannot receive and secure the beads.

8. The system of claim 1, wherein the cord positioning guide means (36) defines between about six and about sixteen cord positioning guide means (36) per foot of extension of the separate-component, retro-fitted guide plate (32) between the first and second side edges (24, 26).

9. The system of claim 1, wherein the animal restraint cord (38) is made of a non-stretch material.

10. A method of rapidly securing a small animal (22) to an existing veterinary table (12), the veterinary table (12) including a support surface (20) extending between a first side edge (24) and an opposed second side edge (26), and also extending between a first end edge (28) and an opposed second end edge (30), the method comprising the steps of:

a. retro-fitting a separate-component, guide plate (32) to at least one of the first end edge (28) or the second end edge (30) of the existing veterinary table (12) so that the separate-component, retro-fitted guide plate (32) covers at least fifty percent of a distance along the end edge (28, 30) between the first and second side edges (24, 26) of the table (12), wherein the separate-component, retro-fitted guide plate (32) defines five or more cord positioning guide means (36) per foot of extension of the separate-component, retro-fitted guide plate (32) between the opposed side edges (24, 26) of the existing veterinary table (12);

b. positioning the small animal (22) on the support surface (20) of the existing veterinary table (12);

c. securing a limb fastening end (46) of at least one animal restraint cord (38) to at least one limb (48) of the small animal (22);

d. prohibiting movement of the cord (38) toward the first side edge (24) or the second side edge (26) by securing an elongate section (50) of the cord (38) within a pre-selected cord positioning guide of the cord positioning guide means (36); and, e. then securing the animal restraint cord (38) against movement toward the small animal (22).

11. A method of rapidly securing a small animal (22) to an existing veterinary table (12), the veterinary table (12) including a support surface (20) extending between a first side edge (24) and an opposed second side edge (26), and also extending between a first end edge (28) and an opposed second end edge (30), the method comprising the steps of:

a. fastening a separate-component, retro-fitted guide plate (32) to at least one of the first end edge (28) or the second end edge (30) of the existing veterinary table (12) so that the separate-component, retro-fitted guide plate (32) covers at least fifty percent of a distance along the end edge (28, 30) between the first and second side edges (24, 26) of the table (12), wherein the separate-component, retro-fitted guide plate (32) defines five or more cord positioning guide means (36) per foot of extension of the separate-component, retro-fitted guide plate (32) between the opposed side edges (24, 26) of the existing veterinary table (12);

b. then positioning the small animal (22) on the support surface (20) of the existing veterinary table (12);

c. then securing a limb fastening end (46) of at least one animal restraint cord (38) to at least one limb (48) of the small animal (22);

d. then prohibiting movement of the cord (38) toward the first side edge (24) or the second side edge (26) by securing an elongate section (50) of the cord (38) within a pre-selected cord positioning guide of the cord positioning guide means (36); and, e. then securing the animal restraint cord (38) against movement toward the small animal (22).

* * * * *